US005651727A

United States Patent [19]

Weinstein et al.

[11] Patent Number: 5,651,727

[45] Date of Patent: Jul. 29, 1997

[54] GROUT REMOVING TOOL AND ADAPTER WHICH EMPLOYS A WATER DELIVERY SYSTEM

[75] Inventors: Peter L. Weinstein, Highland Park; James Allen, Lake Villa; Jason M. Landborg, Palos Hills; David Zimberoff, Chicago, all of Ill.

[73] Assignee: Hoffman & Klemperer, Chicago, Ill.

[21] Appl. No.: 375,771

[22] Filed: Jan. 20, 1995

[51] Int. Cl.[6] ..... B24B 23/00

[52] U.S. Cl. ..... 451/344; 451/359; 451/455; 451/457; 451/449; 451/450

[58] Field of Search ..... 451/344, 354, 451/449, 450, 451, 357; 361/50, 455, 457, 459

[56] References Cited

U.S. PATENT DOCUMENTS

| | | | |
|---|---|---|---|
| 518,352 | 4/1894 | Nightingale . | |
| 1,460,096 | 6/1923 | Davis . | |
| 1,679,323 | 7/1928 | Mortlock . | |
| 2,446,597 | 8/1948 | Kingsbury | 451/450 |
| 2,801,431 | 8/1957 | Eastis . | |
| 3,104,783 | 9/1963 | Hall . | |
| 3,443,272 | 5/1969 | Trelc et al. . | |
| 3,989,391 | 11/1976 | Thorner . | |
| 3,996,496 | 12/1976 | Volk, Jr. . | |
| 3,997,818 | 12/1976 | Bodkin . | |
| 4,087,846 | 5/1978 | Hughes et al. . | |
| 4,089,031 | 5/1978 | Stevens | 361/50 |
| 4,091,577 | 5/1978 | Ortiz | 451/450 |
| 4,099,215 | 7/1978 | Parrier et al. . | |
| 4,102,084 | 7/1978 | Bloomquist . | |
| 4,159,499 | 6/1979 | Bereskin . | |
| 4,206,490 | 6/1980 | Parrier et al. . | |
| 4,490,590 | 12/1984 | Matsuda . | |
| 4,707,759 | 11/1987 | Bodkin . | |
| 4,796,144 | 1/1989 | Swift . | |
| 4,860,147 | 8/1989 | Fai . | |
| 4,910,627 | 3/1990 | Mahlich . | |
| 5,022,190 | 6/1991 | Hutchins | 451/450 |
| 5,179,490 | 1/1993 | Lawrence . | |
| 5,202,662 | 4/1993 | Bienwald et al. . | |

*Primary Examiner*—Bruce M. Kisliuk
*Assistant Examiner*—George Nguyen
*Attorney, Agent, or Firm*—Gerald S. Geren

[57] ABSTRACT

There is disclosed herein an adapter system for use with a hand-held electrically-driven grinding tool, which rotatably drives a grinding wheel for removing grout or mortar from a work site. The adapter system is constructed to controllably deliver a liquid, usually water to the grinding wheel. The adapter system includes a valve assembly mounted to the tool body, which assembly includes: (1) a housing which defines an inlet and an outlet and (2) a shut off valve member positioned within the housing and between the inlet and outlet and operable from external of the housing to selectively provide and interrupt communication between the inlet and the outlet. There is also provided a supply conduit leading from a source and connected to the inlet for delivering liquid from the source to the valve housing inlet. A flexible delivery conduit is provided and connected to the valve housing and positionable adjacent to periphery of the grinding element. The valve can be mounted to the grinding tool and then a grasping handle can be mounted to the valve and a wheel-like adapter is provided for that connection. A unitary housing for electric and water connections is also provided which includes a ground fault interrupter and can include an electric/water interlock whereby electric operation is prevented until the water connections are made.

6 Claims, 2 Drawing Sheets

GROUT REMOVING TOOL AND ADAPTER WHICH EMPLOYS A WATER DELIVERY SYSTEM

BACKGROUND OF THE INVENTION

This invention relates to a hand-held, electrically-driven grout or mortar removal tool, and more particularly an adapter used therewith to deliver water to the work site.

The process of tuckpointing is well known and includes the removal of grout (i.e. cement or mortar) from between bricks and replacement of the removed grout with new grout. The removal of the old grout can be achieved using a hand-held electrically-driven grout removal tool which includes a rotating abrasive grinding wheel that contacts and removes the old grout.

However, in the process of grout removal, large quantities of dust can be created. This dust can enter the tool and its internal works and thus reduce the useful life of the tool. The dust can also create safety problems requiring that operator wear a mask or hood. Moreover, if the interior of the building that is being tuckpointed is operated under a negative pressure (i.e. less than the ambient pressure) the dust can be drawn into the building and undesirably coat the interior.

Thus, it is an object of this invention to provide a tool and an adapter for a tool that safely minimizes dust from the grout removal operation.

In the past, in connection with other devices a liquid has been delivered to rotating wheel/work interfaces to enhance lubrication, or for washing. Several U.S. Patents disclose such apparatus. See U.S. Pat. Nos. 518,352; 1,490,096; 2,801,431; 3,104,783; 3,443,272; 3,989,391; and 4,102,084. However, none of these patents show or suggest a grout removing tool and more specifically the use of a liquid delivery system with a hand-held electrically-driven grout removal tool.

Thus, it is another object of this invention to provide for the delivery of a liquid to the grinding wheel of an electrically-driven grout removal tool.

At the present time, there are grinding tools manufactured by several different companies. Although these tools are all similar in that they are hand-held electrically-driven and of a somewhat similar construction.

It is yet another object of this invention to provide an adapter so that this delivery system can be used with many of these tools.

These tools are electrically driven so it is desirable when using a water-based liquid with the tool, to minimize the risk of electric shock and to the operation. The use of a ground fault interrupter (GFI) may be appropriate. Moreover, it is believed to be desirable to provide a system where the proper electrical and water connections are made and to minimize the chance of a bypass that could result in a risk to the operator.

It is a further object of this invention to provide an electrical/water connection system wherein a GFI is employed and which maximizes the use of proper water and electrical connections.

These and other objects of this invention will become apparent from the following description and appended claims.

SUMMARY OF THE INVENTION

There is disclosed herein an adapter for use with a hand-held electrically-driven grout removal tool, for the controllable delivery of water to the tool's grinding wheel at the wheel/work interface. The adapter is intended to fit numerous hand-held electrically-driven grout removal tools.

The adapter includes an on/off water shut off valve that is constructed to be mounted to the tool. A conduit delivers water to the valve from a source. A flexible conduit secured to the valve delivers water from the valve to a nozzle at the end of the conduit. The nozzle end is positioned adjacent the grinding wheel, at a point where the wheel contacts the grout so as to minimize dust formation.

The valve is mounted to the tool and a grasping handle is mounted to the valve. A shut-off associated with the valve controls water flowing through the valve.

A hood or boot is positioned over the front or head end of the tool adjacent the grinding wheel to minimize water and etc. from entering the tool.

An integral housing for water/electrical connection is provided which includes supply and tool connections for both the water and electric service. A GFI is provided integral with the housing. If this housing is used, the risk to the operator minimized.

DESCRIPTION OF THE PREFERRED EMBODIMENTS

Figure 1:
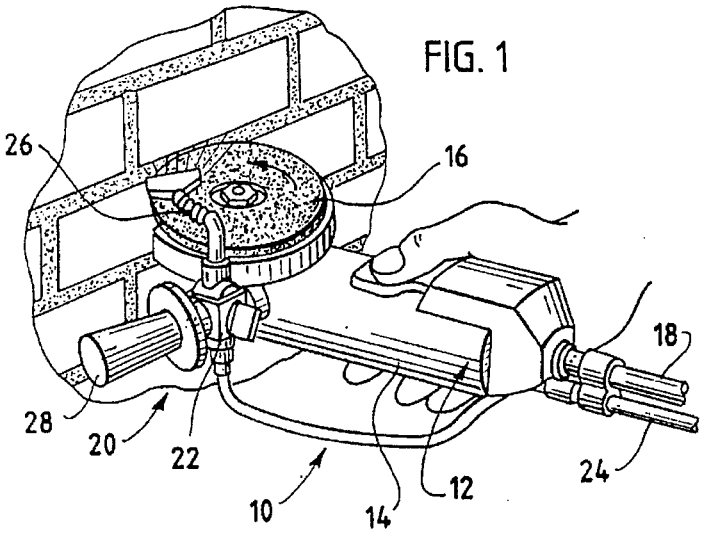
FIG. 1 is a perspective view showing a grout removal tool and adapter assembly positioned against a wall for grout removal.

Referring first to FIG. 1, there is shown a hand-held electrically-driven grinding tool assembly 10 generally. The assembly includes a grinding tool 12 having a body 14 within which an internal electrical drive mechanism is housed and that drives the grinding wheel 16 via a geared transmission (not shown) at the head end of the tool. A power cord 18 delivers power to the drive and which causes the grinding wheel 16 to rotate.

The adapter assembly 20, generally includes a valve 22 that is mounted to the tool, and an incoming water supply line 24 is connected to the valve 22. A spray mechanism 26 is also connected to the valve 22 for delivering water to the grinding wheel at or about the point of contact of the grinding wheel 16 with the grout. A threaded construction is provided for connecting a grasping handle 28 to the valve 22. In operation, the tool operator can grasp and activate the tool with one hand, and apply pressure to the tool to control the grout removal via the handle 28 using the other hand.

Figure 2:
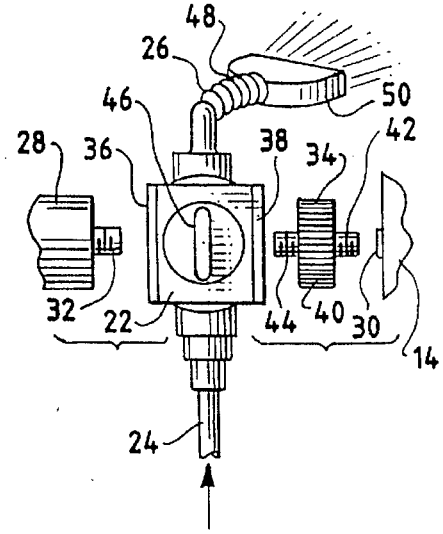
FIG. 2 is a elevational view showing a valving system wherein water is delivered to a shut off valve and then delivered to a nozzle spray device. Also shown is a threaded handle for mounting the handle to the valve and an adapter for mounting of the valve to the tool.
Figure 3:
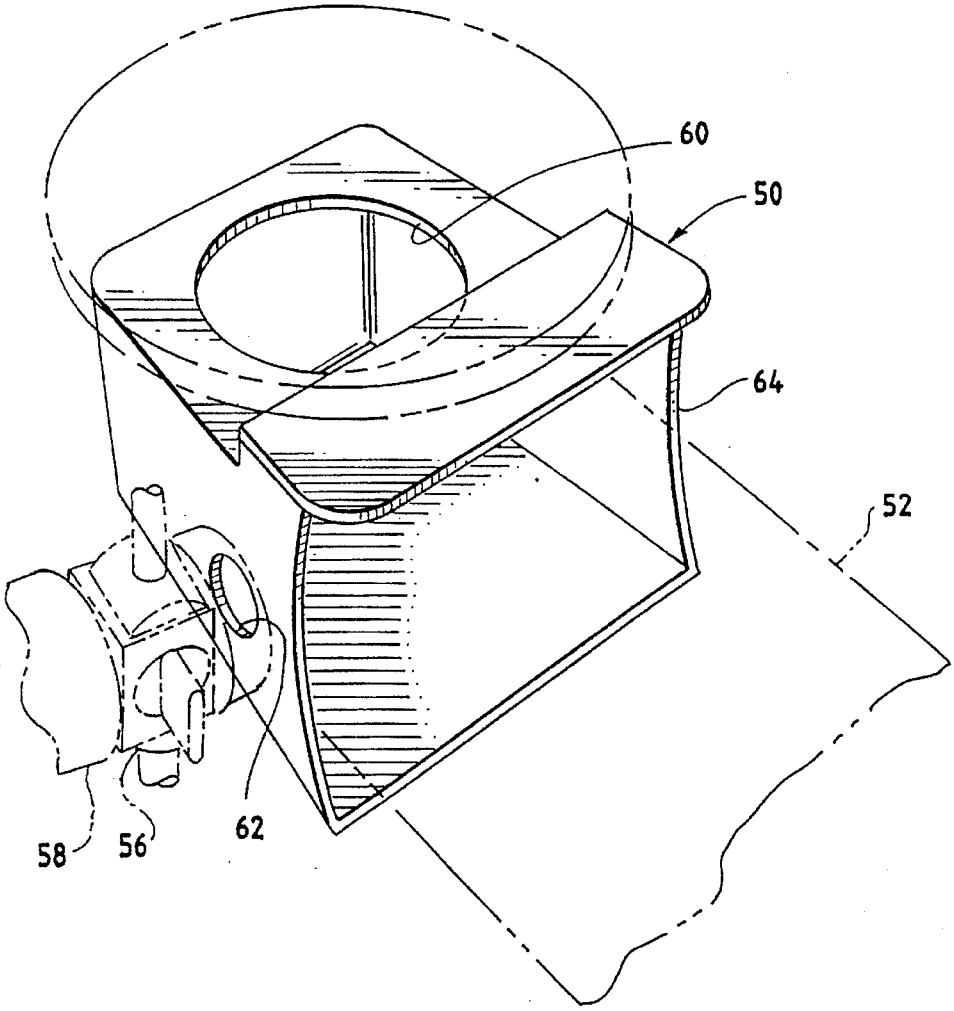
FIG. 3 is a perspective view of a hood or boot style protective device which is fitted onto the tool, so as to protect the tool's internal mechanism from grinding dust and water entry.

Referring now to FIG. 2, the tool body 14 includes an internally threaded opening 30 which is constructed to receive a handle 28 which has an integral externally threaded projection 32. In this way the handle can be mounted directly to the tool. The valve 22 has been constructed to be positioned between the tool and the handle. However, other arrangements can be constructed, where the valve is not mounted directly to the body, but rather indirectly as with a bracket that carries the valve but is mounted to the tool or handle.

In the preferred embodiment a connector 34 is provided to connect the tool body and valve. The valve 22 is internally threaded at each side as at 36 and 38. The connector has a wheel like construction 40 with two externally threaded projections 42 and 44. The projection 42 is constructed to threadably engage the tool body opening 30. The external thread 44 is constructed to engage the valve internal threaded section 38. This construction holds the valve to the tool body. The handle 28 can be then threaded into the valving at the other thread 36. In this way the handle can be present and valve is held to the tool. It will be appreciated that a similar construction can be provided on the other side of the tool for convenience and so as to accommodate different handed operators.

In the system, incoming water flows via line 24 to the valve 22. At the valve 22, there is provided a shut off valve 46 in communication with the water line 24 so as to control the flow of water through the valve and to shut off the flow therethrough. Control of the volume of the water is achieved at the supply water exiting the valve flows to the spray device 26. The spray device 26 includes a flexible and positionable conduit 48 which is connected to one end of the valve 22 and has a nozzle 50 mounted at the other end. It will be appreciated that by use of the flexible conduit 48, the nozzle can be positioned adjacent the work and grinding wheel so as to wet the surface and/or materials coming out of the work surface and thus minimize dust.

At the present time, grout removal tools have a relatively short life (e.g. 6–9 months). This is believed to be due to grout dust that can enter the tool body and abrasively damage the internal workings. Usually, dust enters the body at the head end of the tool adjacent the grinding wheel and where the electric drive within the tool body 44 engages a transmission that drives the grinding wheel 16.

A cap-like boot or cover 50 has been developed to enclose the tool's head end and protect the tool. The boot is placed over the tool but still permits exposure and the operation of the grinding wheel 54. The boot includes side openings which permit connection of the valving system 56 and handle 58 to the tool body. In the embodiment shown, the boot is a squared cap-like structure which is constructed to fit over the front end of a tool 52. The boot has an opening 60 through which the grinding wheel drive can extend so as to connect to the grinding wheel 54. An access opening 62 is provided on the side of the boot so as to permit the valve and handle to threadably engage the tool. A second valving access hole of the same type shown is provided on the other side of the boot in order to permit connection of the valve or handle on either side of the tool. In general, it is seen that the valving access holes are at right angles to the grinding wheel drive access hole. Other than those openings and the tool insertion end 64, the boot is closed. Thus, the boot provides a protective cover about the head end of the tool so as to minimize the entry of grout, dust, water, etc. from the exterior through the boot into the tool body and the tool drive.

Figure 4:
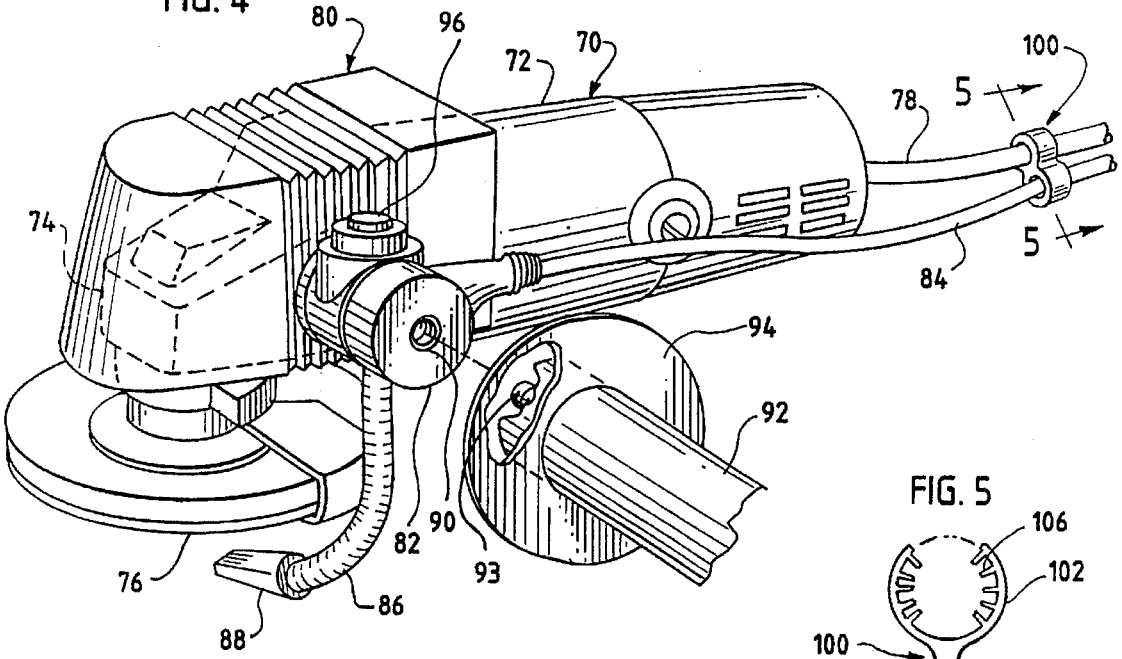
FIG. 4 is a perspective view of another style of grinding tool showing the boot, grinding wheel and water delivery system.
Figure 5:
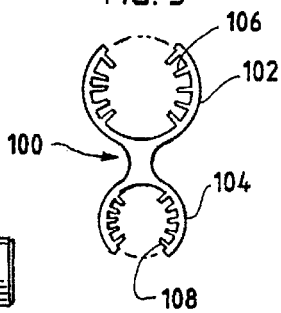
FIG. 5 is a cross-sectional view taken along line 5—5 of FIG. 4 showing a retaining clip for holding the waterline and an electric power line together.

Referring now to FIG. 4, another style tool 70, generally is shown. There the tool includes the tool body 72, the head or transmission end 74 and the rotating grinding wheel 76. The tool is powered through the electric cord 78. On this tool there is provided a hood or boot 80 which covers the head and has appropriate openings for the grinding wheel drive 76, the tool body 72 and the valving. In this system, there is shown a push button shut-off valving system 82, which is connected to a water conduit or line 84 which is in turn connected to a supply (not shown). Water is delivered from the valve, flows through the flexible conduit 86 to a nozzle 88 adjacent the grinding wheel. The valve is threaded into the tool body 72 and includes an internally threaded handle receiving opening 90 that receives the handle 92 and the specifically threaded projection 93. Thus, the handle can be screwed into the valve. The valve is operated by the push button 96 located at the top of the valve body. It will be appreciated that this is an on/off system so that there is either water flow or no water flow through the valve body and that the valve body handle can be mounted on either side of the grout removal tool. It is to be noted that the handle 92 includes a shield 94 adjacent the threaded stud or projection 93.

A clip 100 keeps the electric cord and the water conduit together is shown in FIG. 4. The clip 100 includes an electrical cord receiving section 102 and water conduit section 104. Each of the sections are open at their ends so as to permit insertion of the respective cords. A plurality of grasping fingers such as 106 and 108 are provided on the inside of the grasping sections so as to hold the cords in position.

Figure 6:
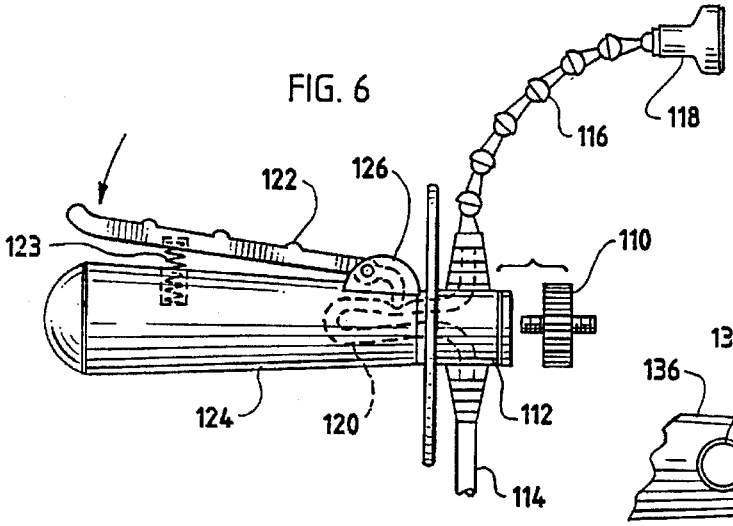
FIG. 6 is a view of an alternative handle and valving system.

Another alternate system is shown in FIG. 6 for operating the valve. There as shown in FIG. 6, system includes the threaded adapter 110 and valve housing, the incoming water enters the via line 114 and exits via the flexible line 116 and the nozzle 118. However, inside the valve body and handle, the water carrying conduit 120 is looped around so as to form a squeezable area.

A pivotable on/off handle 122 is mounted to the grasping handle 124 and is manipulable by the fingers of the user. The handle includes a short section 126 that is biased downwardly into engagement with the conduit so as to cut off water flow or can be moved out of engagement so as to permit flow. It is seen that a biasing spring 128 is provided to urge the handle 122 upwardly and the short section 126 downwardly so as to close off the water flow. Thus, water flow is initiated when the operator pulls the on/off handle 122 toward the grasping handle 124 so as to release the short section 126 and permit water to flow through the conduit.

Figure 7:
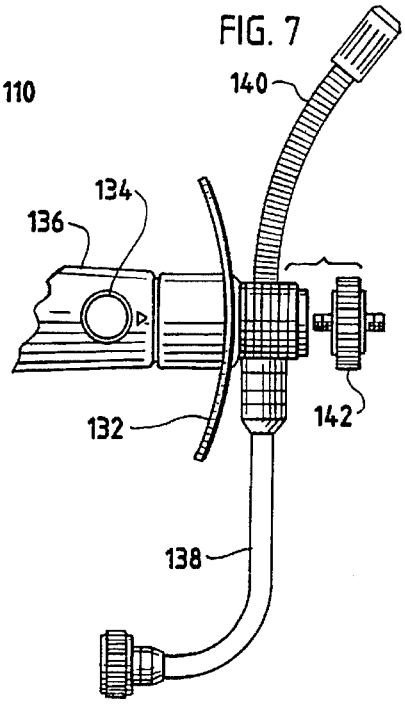
FIG. 7 is a alternative system for delivering water to the grinding wheel.

A similar alternate system is shown in FIG. 7 and that includes the handle 130 which includes a curved shield 132 and a shut off button 134 that is constructed to control the flow through supply conduit 138 to the flexible conduit 140. In this situation, the on/off control is integral with the handle. An adapter wheel 142 is provided for securing the handle to the body of the grout removal tool.

A ground fault interrupter (GFI) is provided, so as to minimize electrical hazards to the operator. In this system, the GFI is in the same housing with the electrical and water connections. Use of the housing discourages electrical bypass or in other words encourages use of the connector and GFI.

Figure 8:
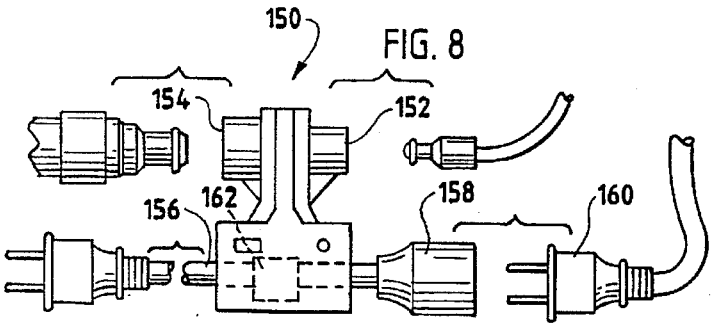
FIG. 8 is a view of an integral water/electric connection housing with water and electric connection and GFI shown.

Referring to FIG. 8, a unitary housing 150, for the GFI and water and electrical connections is shown. The housing is provided with a water side and an electrical side. On the water side, there is provided a connection 152 to connect the housing and tool. The connection 154 connects the water supply to the housing. Note that the connections are different sized connections to minimize confusion and force use of the housing. Thus, water can flow from the source, through connection 154, through housing 150, and out connection 152 to the tool.

The electrical side includes an incoming power cord 156 that is connected to the power source and to the housing 150. An outgoing power receptacle 158 is provided for connection to the tool power cord 160. Thus, power from an external source can flow through the power cord 156, the housing 150 and the power receptacle.

A ground fault 162 is shown as a block box that is positioned inside the housing and associated with the housing and between the incoming and outgoing power. The GFI is shown generally since different specific systems can be used. For references disclosing specific GFI systems includes U.S. Pat. Nos. 3,996,496; 3,997,818; 4,087,846; 4,099;215; 4,159,499; 4,206,490; 4,490,590; 4,707,759; 4,796,144; 4,860,147; 4,910,627; 5,179,490; and 5,202,662.

From this view, it is seen that the housing for the water connection, electric connection and GFI is integral.

In operation, an adapter assembly is selected which includes the water supply conduit, valving and flexible water delivery system with a nozzle. The appropriate valve is selected as well as the handle and it is determined whether the operator is left-handed or right-handed. The water delivery adapter is then mounted to the tool. That will include mounting the protective boot such as 50 and then the supply conduit is clipped to the electric line. The valve, adapter, handle are appropriately positioned along with the flexible spray conduit. At that point, no water is flowing and no power is provided and the valve is in an off position. The appropriate water and electrical connections are then made to the housing 150.

The water and electrical connections are made to the integral housing so that power and water are available to the tool and adapter and the GFI is in position for activation.

As the unit is moved to the work position, the valve can be moved to the on position so water will flow and then the grinding wheel is started. It will be noted that the grinding wheel will remove grout and create dust, however, the water will combine with the dust so as to the minimize dust formation.

As it can be appreciated, the valving system can be in a number of embodiments as well as the hood.

With the electrical and water connections in place, the GFI is in position to protect the user in the event the tool fails.

It will be appreciated that this type of adapter system is useful for many different grout removing tools.

It will be appreciated that numerous changes and modifications can be made to the embodiments disclosed herein without departing from the spirit and scope of this invention.

We claim as our invention:

1. A portable hand-held electrically-driven grinding tool for use in removing grout or mortar from a work site, which tool includes;

an elongated hand-graspable body that encloses the drive, a grinding wheel head mounted to the body at one end of the body so that the axis of rotation for a grinding wheel mounted on the head is substantially at right angles to the body, a generally disk-shaped abrasive grinding wheel mounted to the head and rotatable therewith so that the grinding wheel edge or periphery can engage the grout or mortar;

a valve assembly mounted to the tool which assembly includes: (1) a housing which defines a liquid inlet and a liquid outlet; and (2) a shut off valve member positioned within the housing between the inlet and outlet and operable from external of the housing to provide and to interrupt communication between the inlet and the outlet;

a supply conduit connected to the inlet for delivering water-based liquid to the valve housing inlet;

a flexible delivery conduit connected to said housing and positionable adjacent the periphery of the grinding wheel so as to deliver water-based liquid from the valve housing to the grinding wheel periphery whereby the grinding wheel can be wetted during grinding so as to reduce dust and like;

the valve housing defining a first internally threaded aperture; and there being provided a threaded wheel-like adapter constructed to connect to the first internally threaded aperture and to the tool;

the valve housing defining a second internally threaded aperture positioned opposite the first internally threaded aperture and there is provided a grasping handle which is externally threaded and constructed to threadably engage said second internally threaded aperture;

the tool including a tool body and having a grinding wheel for removing grout or mortar from a work site and having an internally threaded aperture to receive said wheel-like adapter;

a water shielding boot member secured to the tool body adjacent the grinding wheel to shield the body and internal mechanism from liquid and dust;

said boot including an opening for receiving the tool, an access opening for the grinding element and a pair of access openings for the handle and valve connection to the tool body; and water/electrical housing having an incoming water connection, an outgoing water connection, an incoming power connection, an outgoing power connection and a ground fault interrupter associated with the incoming power connection and outgoing power connection.

2. A portable hand-held electrically-driven grinding tool for use in removing grout or mortar from a work site, which tool includes;

an elongated hand-graspable body that encloses the drive, a grinding wheel head mounted to the body at one end of the body so that the axis of rotation for a grinding wheel mounted on the head is substantially at right angles to the body, a generally disk-shaped abrasive grinding wheel mounted to the head and rotatable therewith so that the grinding wheel edge or periphery can engage the grout or mortar;

a delivery system for delivering water-based liquid to the grinding wheel periphery, which system includes:

a valve assembly mounted to the body which assembly includes: (1) a housing which defines a liquid inlet and a liquid outlet; and (2) a shut off valve member positioned within the housing between the inlet and outlet and operable from external of the housing to provide and to control communication between the inlet and the outlet;

a supply conduit connected to the inlet for delivery of water-based liquid to the valve housing outlet; and a flexible delivery conduit connected to the valve housing outlet and positionable adjacent the periphery of the grinding wheel so as to deliver water-based liquid from the valve housing to the grinding wheel periphery;

a ground fault interrupter associated with said body and electrical drive so as to maximize the protection in the event of a safety hazard which can cause tool failure; and "including a water shielding boot member adapted to minimize water-based liquid and grinding dust from entering the body, said boot including a portion for receiving said body and said head, but for exposing the grinding wheel and including an access opening for exposure of the grinding wheel and at least one access opening for the handle or the valve connection to the body."

3. A grinding tool as in claim 2 wherein said housing a unitary water/electrical housing having said liquid inlet, said liquid outlet, an incoming electrical connection, and outgoing electrical connection, wherein said ground fault interrupter is associated with both of the incoming electrical connection and the outgoing electrical connection, and wherein the liquid inlet is differently shaped than the liquid outlet.

4. A grinding tool as in claim 2 wherein the valve housing defines a first internally threaded aperture, and there is further provided a threaded wheel-like adaptor constructed to threadably engage the first internally threaded aperture and also connect to the tool.

5. A grinding tool as in claim 4 wherein the valve housing defines a second internally threaded aperture opposite the first internally threaded aperture and there is provided a grasping handle which includes an externally threaded position and constructed to threadably engage said second internally threaded aperture.

6. An adapter system for use with a portable hand-held electrically-driven grinding tool that is used in removing grout or mortar from a work site, which tool includes; an elongated hand-graspable body that encloses the drive, a grinding wheel head mounted to the body at one end of the body so that the axis of rotation for a grinding wheel mounted on the head is substantially at right angles to the body, a generally disk-shaped abrasive grinding wheel mounted to the head and rotatable therewith so that the grinding wheel edge or periphery can engage the grout or mortar; said adapter constructed to minimize dust and water access to said tool drive and to enhance safety of the tool in use, said adapter system includes:

a delivery system for delivering water-based liquid to the grinding wheel periphery, which system includes:

a valve assembly mounted to the body which assembly includes: (1) a housing which defines a liquid inlet and a liquid outlet; and (2) a shut off valve member positioned within the housing between the inlet and outlet and operable from external of the housing to provide and to control communication between the inlet and the outlet;

a supply conduit connected to the inlet for delivery of water-based liquid to the valve housing outlet; and a flexible delivery conduit connected to the valve housing outlet and positionable adjacent the periphery of the grinding wheel so as to deliver water-based liquid from the valve housing to the grinding wheel periphery;

a ground fault interrupter associated with said body and electrical drive so as to maximize the protection in the event of a safety hazard which can cause tool failure; and a shielding boot member adapted to minimize water-based liquid and grinding dust from entering the body, said boot including a portion for receiving said body and said head, but for exposing the grinding wheel and including an access opening for exposure of the grinding wheel and at least one access opening for the handle or the valve connection to the body.

* * * * *